United States Patent [19]

Nagayasu

[11] Patent Number: 5,029,218

[45] Date of Patent: Jul. 2, 1991

[54] NOISE CANCELLOR

[75] Inventor: Katsuyoshi Nagayasu, Yokohama, Japan

[73] Assignee: Kabushiki Kaisha Toshiba, Kawasaki, Japan

[21] Appl. No.: 414,266

[22] Filed: Sep. 29, 1989

[30] Foreign Application Priority Data

Sep. 30, 1988 [JP] Japan ..... 63-246430
Jun. 30, 1989 [JP] Japan ..... 1-169554

[51] Int. Cl.[5] ..... G10K 11/16
[52] U.S. Cl. ..... 381/71; 381/94
[58] Field of Search ..... 381/71, 94

[56] References Cited

U.S. PATENT DOCUMENTS

| | | | |
|---|---|---|---|
| 4,122,303 | 10/1978 | Chaplin et al. | 381/71 |
| 4,473,906 | 9/1984 | Warnaka et al. | 381/73.1 |
| 4,607,528 | 8/1986 | Kallergis | 381/71 |
| 4,677,676 | 6/1987 | Eriksson | 381/71 |
| 4,683,590 | 7/1987 | Miyoshi et al. | 381/94 |
| 4,736,431 | 4/1988 | Allie et al. | 381/94 |
| 4,862,506 | 8/1989 | Landgarten et al. | 381/94 |
| 4,878,188 | 10/1198 | Ziegler, Jr. | 381/71 |

FOREIGN PATENT DOCUMENTS

| | | |
|---|---|---|
| 0043565 | 1/1982 | European Pat. Off. . |
| 63-311396 | 12/1988 | Japan . |
| 2149614 | 6/1985 | United Kingdom . |
| 2154830 | 9/1985 | United Kingdom . |

OTHER PUBLICATIONS

J. E. Ffowes Williams et al; "Anti-Phase Noise Reduction"; 1985; Phys. Technol.; vol. 16; pp. 19-24, 31.

*Primary Examiner*—Forester W. Isen
*Attorney, Agent, or Firm*—Oblon, Spivak, McClelland, Maier & Neustadt

[57] ABSTRACT

A noise cancellor includes a first sensor for detecting a noise generated from a driving device and converting the noise to electric signals. A signal processor receives the electric signals and forms control signals by multiplying the electric signals by a predetermined factor series. In response to the control signals, a speaker produces sound which interferes with the noise so as to cancel the noise at an object point. A second sensor detects sound at the object point and converts them to electric signals which are inputted to the signal processor. The signal processor switches the control mode, in accordance with a predetermined condition, to an adaptive active control wherein the factor series is changed in response to the electric signal applied from the second sensor or an active control wherein the factor series is fixed.

26 Claims, 7 Drawing Sheets

NOISE CANCELLOR

BACKGROUND OF THE INVENTION

1. Field of the Invention

This invention relates to a noise cancellor, and in particular to a noise cancellor for actively canceling noises at an object point.

2. Description of the Related Art

Driving devices such as rotating machines, except for particular devices, generate noise when they are operating. The noise bring about various adverse influences on the environment. Generally, however, it is extremely difficult to obtain noiseless driving devices Conventionally, there has been developed a noise cancellor for reducing noise at a specific place by using an acoustic technique. With this noise cancellor sound waves having reverse phases to and equal magnitudes to those of the noise at the specific place are artificially produced and are caused to interfere with the noise, thereby to actively cancel the noise at the specific place.

For example, in order to prevent that noise generated from a driving device as a noise source in a chamber leak out through the aperture of the chamber, it is possible to cancel the noises at the aperture, i.e., at an object point, by using this noise cancellor. In this case, the noise cancellor is generally constructed such that the noise generated by the driving device are detected by a receiver such as a microphone provided in the chamber and are converted into electric signals which are inputted to an arithmetic unit through an amplifier and an A/D converter. The signals output from the arithmetic unit are inputted through a D/A convertor to a sound generator such as a speaker provided near the aperture for producing required sound waves.

Let it be assumed that the noise generated by the driving device be S1, the sounds produced by the speaker be S2, the noise detected by the microphone be R1, the noise at the object point be R2, and the transfer functions between the driving device and the microphone, the driving device and the object point, the speaker and the microphone, and the speaker and the object point be T11, T12, T21 and T22, respectively, the following equation of a two-input two-output system is obtained:

$$\begin{matrix} R1 \\ R2 \end{matrix} = \begin{matrix} T11 & T21 \\ T12 & T22 \end{matrix} \begin{matrix} S1 \\ S2 \end{matrix} \tag{1}$$

Since the noise cancellor is intended to make the sound level be zero, R2 can be set to be zero. Therefore, the following equation is obtained.

$$S2=(R1\cdot T12)/(T12\cdot T21-T11\cdot T22) \tag{2}$$

As understood from Eq. 2, if the sounds S2, which is obtained by multiplying the noise R1 detected by the microphone by a filter factor h, may be produced from the speaker, it is possible to make R2 be 0, where $$h=T12/(T12\cdot T21-T11\cdot T22) \tag{3}$$

Therefore, when the filter factor series (impulse responses) for minimizing the noise at the aperture of the chamber is calculated and stored in the arithmetic unit of the noise cancellor, the optimum S2 can be obtained from the following equation:

$$S2=R1\cdot h \tag{4}$$

Two noise canceling methods are considered when Eq. (4) is used.

With one method, time series signals obtained from the microphone are converted by means of Fourier transform to obtain frequency domain signals and the obtained signals are multiplied by transfer functions of the frequency domain designation. Thereafter, the resultant signals are converted again to time series signal by means of inverse Fourier transform, and these new time series signals are input to the speaker to produce sounds.

With this method, it is difficult to produce control sounds by the speaker at real time, because the signals are processed in batch. Since, however, a driving device such as a rotating machine repeatedly generates sounds having substantially the same waves, noise can be canceled by adjusting the timing of producing control signals in accordance with trigger signals which synchronize with the rotation of the rotating machine.

With the other method, transfer functions are converted to so called filter factor series (impulse responses) by means of inverse Fourier transformation. Further, time series data to be inputted to the speaker is obtained by convoluting the filter factor series and the time series data which are detected through the microphone. This second method is called FIR filter system, FIR being the abbreviation of Finite Impulse Response, and produces control sounds at real time.

With the second method, the control sounds are given by the following equation:

$$S2\,(n) = \sum_{i=0}^{M-1} h(i)\,X(n-1) \tag{5}$$

where h(i) is a filter factor series, X(n−1) is a closest sample datum of the i'th input signal, M is a tap number, i is a tap factor number, and S2(n) is the n'th output datum.

When both methods are used, noise at the aperture of the chamber can be actively canceled, and thus the noise generated by the driving device in the chamber can be prevented from leaking out of the chamber through the aperture.

With the conventional noise cancellors, however, the transfer functions from which the filter factor series are calculated are not always constant. In other words, the transfer functions vary according to the temperature change in the transmission paths of the sound, the change in the output characteristics of the speaker, the change in the characteristics of the driving device, and the like. For example, when the temperature in the chamber rises by heat generated from the driving device, the speed of sound changes, and this speed change varies the acoustic transfer functions. Further, when the speaker is continuously energized, the temperature of the coils of the speaker becomes higher and its resistance changes, whereby the output of the speaker and the transfer functions vary. If the noise generating positions of the driving device vary in the course of the operation of the device, the acoustic transfer functions also vary. Such variation of the transfer functions reduces effect of noise cancelation at the object point. In order to carry out effective noise cancelation, therefore, it is necessary to alter the value of the filter factor series according to the change of the transfer functions.

For the purpose of overcoming the above problem, recently a noise cancellor has been developed which is provided with an adaptive control function. In this cancellor, another microphone is arranged at the object point, and the filter factor series is automatically altered so that the outputs from the microphone become zero. The filter factor series of the noise cancellor having this control function is changed at constant time intervals according the following equation:

$$h(i)\ new = h(i)\ old + Ke\ X(n-i) \quad (6)$$

where h(i) new is the i'th FIR filter factor after the alteration, h(i) old is the i'th factor before the alteration, K is a constant defining the alteration ratio of h, e is an error signal which is detected by the microphone at the object point, and X(n−i) is a closest sample datum of the i'th input signal.

However, this noise cancellor is encountered with the problems set forth below.

With this noise cancellor, the filter factor series is changed at constant time intervals while K is kept constant. The reason why K is kept constant is that the standard of changing K is not clear. However, if K is always kept constant, the following problems occur. When the time constant of the change of the physical factors, which determine the transfer function, is substantially identical to the time constant of the change of the filter factor h determined by the value of K, resonance occurs. Further, when the time constant of the change of the filter factor h depending on K is larger than that of the physical factors, control cannot be performed in accordance with the change of the physical factors. If the time constant of the change of h is rendered very small by increasing the value of K, the robustness of the control system is reduced. When it is known in advance that the change of the physical factors is slow, it is necessary that the value of K be very small. Very small K, however, leads to omission of bits or the like when signals are processed. Accordingly it is very difficult to select the value of K.

The disadvantages occurring from the alteration of the filter factor series at constant time intervals are as follows:

When the filter factors are altered too often by rendering the time interval too short, the robustness of the control system is reduced. On the contrary, when the frequency of the alteration is rendered small by making the time interval long, the control cannot follow to the change of the transfer function.

As described above, with the noise cancellor having an adaptive control function, the frequency of the change of the filter factor series, that is, the control convergence ratio of the control system is always constant, whereby the stability and the convergence may deteriorate, depending on the operation conditions of the noise cancellor and the driving device.

Further, with the conventional noise cancellors, when external noise propagates to the object point after the adjustment of the filter factor series has been finished and the convergence of control has been attained, the cancellors malfunction, changing the filter factors with the result that the complete noise reduction cannot be attained. Far from that, surplus sounds are produced at the object point.

SUMMARY OF THE INVENTION

The present invention is contrived in consideration of the above circumstances and its object is to provide a noise cancellor and a noise canceling method which can perform stable and efficient control of noise in accordance with the operational condition of a driving device and the like without malfunction due to an external noise.

In order to obtain this object, according to this invention, the control convergence ratio of a control system is adjusted by switching control mode, in accordance with a predetermined condition, to an adaptive active control wherein the filter factor series is suitably changed in accordance with inputs measured at the object point or an active control wherein the filter factor series is kept constant. The predetermined condition described above means, for example, the frequency of the change of the filter factor series, which is determined by the operating condition of the noise cancellor including the driving device, the frequency of the change of the filter factor series, which is determined by the elapsed time from the starting of the driving device as a noise source, or the like.

Further, according to this invention, during the adaptive active adopting control, the frequency of the change of the filter factor series is altered in accordance with the operating condition.

With this invention, the alteration of the filter factor series changes the control convergence K of the filter factor series, enabling the optimum convergency to be automatically selected. Therefore, it is possible to realize an adaptive active adopting control which can improve both the stability and convergence of the noise control. After the alteration of the filter factor series, the noise cancellor does not malfunction due to an external noise or the like, and the filter factor series is not changed by the external sounds or the like. This provides more stable control of adaptive active noise cancelation.

Further, with this invention, the filter factor series includes only specific frequency components based on the frequency of the rotation of the driving device. Accordingly, it is possible to prevent that the elimination control is performed in response to an external noise having the frequencies other than said frequency components, thereby facilitating more stable noise control.

BRIEF DESCRIPTION OF THE DRAWINGS

FIGS. 1 to 4 show a noise cancellor according to a first embodiment of the present invention, in which:

FIG. 1 is a sectional view schematically showing the overall noise cancellor;

FIG. 2 is a flow chart illustrating the control of the noise cancellor;

FIG. 3 is a view showing the operating conditions of a driving device; and

FIG. 4 is a flow chart illustrating the control of the noise cancellor in response to the operating condition of the driving device;

FIGS. 6 to 9 show a noise cancellor according to a third embodiment of the present invention, in which:

FIG. 6 is a sectional view of the overall noise cancellor;

FIG. 9 is a sectional view showing a device for obtaining filter factor series;

DETAILED DESCRIPTION OF THE PREFERRED EMBODIMENTS

This invention will be explained in detail by way of embodiments with reference to the accompanying drawings.

Figure 1:
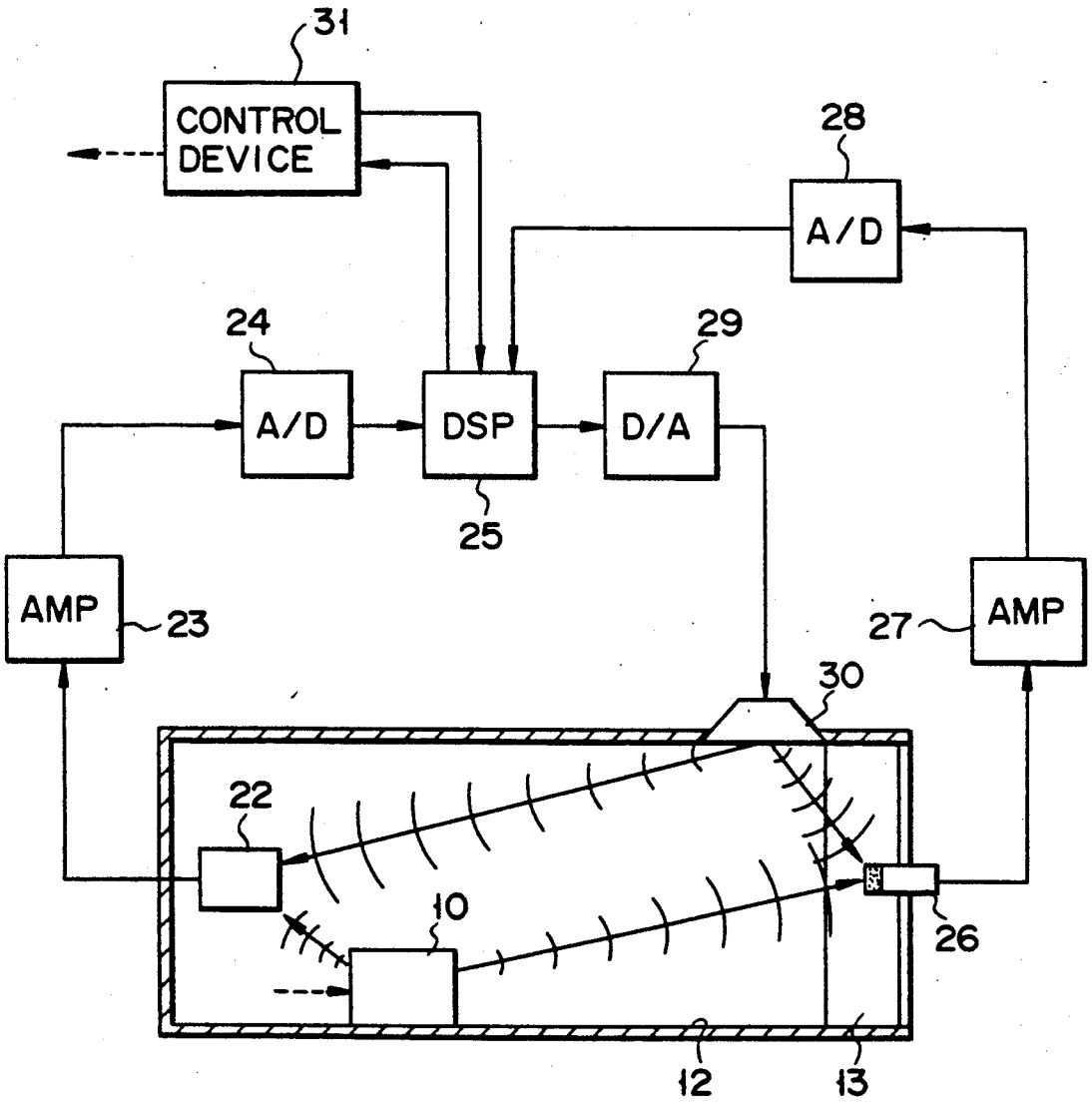

FIG. 1 shows a noise cancellor of an embodiment of this invention, with which noise generated from a driving device such as a compressor 10 provided in a chamber 12 is prevented from leaking out of the chamber through the aperture 13 thereof.

The noise cancellor has a first sensor 22 such as an acceleration pickup or a microphone, which is arranged near the compressor 10 in the chamber 12. The sensor 22 detects the noise or vibrations generated from the compressor 10 and converts them to electric signals which are inputted to a digital signal processor 25 through an amplifier 23 and an A/D converter 24. The signal processor 25 uses, as FIR (Finite Impulse Responses), a required filter factor series h(i) as described later and stored in the signal processor 25, and produces control signals from the input signals. The noise cancellor is provided with a speaker 30 as sound producing means, which is located at the vicinity of the aperture 13. The speaker 30 receives the control signals from the signal processor 25 through a D/A converter 29 and produces sounds interfering with the noises from the compressor 10, thereby canceling the noise at the aperture 13 as an object point. The sound pressure at the aperture 13 is detected by a second sensor 26 such as a microphone and is converted to electric signals which are inputtd to the signal processor 25 via an amplifier 27 and an A/D converter 28. The signal processor 25 changes the stored filter factor series such that the values of the output signals of the converter 28 becomes zero, namely, the sound pressure at the aperture 13 becomes zero.

The signal processor 25 is connected to a control unit 31 which controls the start and stop of the compressor 10 and receives the instructions for the start and stop of the compressor 10 from the unit.

The operation of the noise cancellor will be explained.

Before starting the noise cancellor, filter factors h are not set in the signal processor 25 of the noise cancellor. In order to provide a basis for the filter factors, the values corresponding to the filter factors $h_m$ altered last time and the filter factors $h_{m-1}$ from which $h_m$ was altered are natually set in the signal processor 25 before starting the cancellor.

Figure 2:
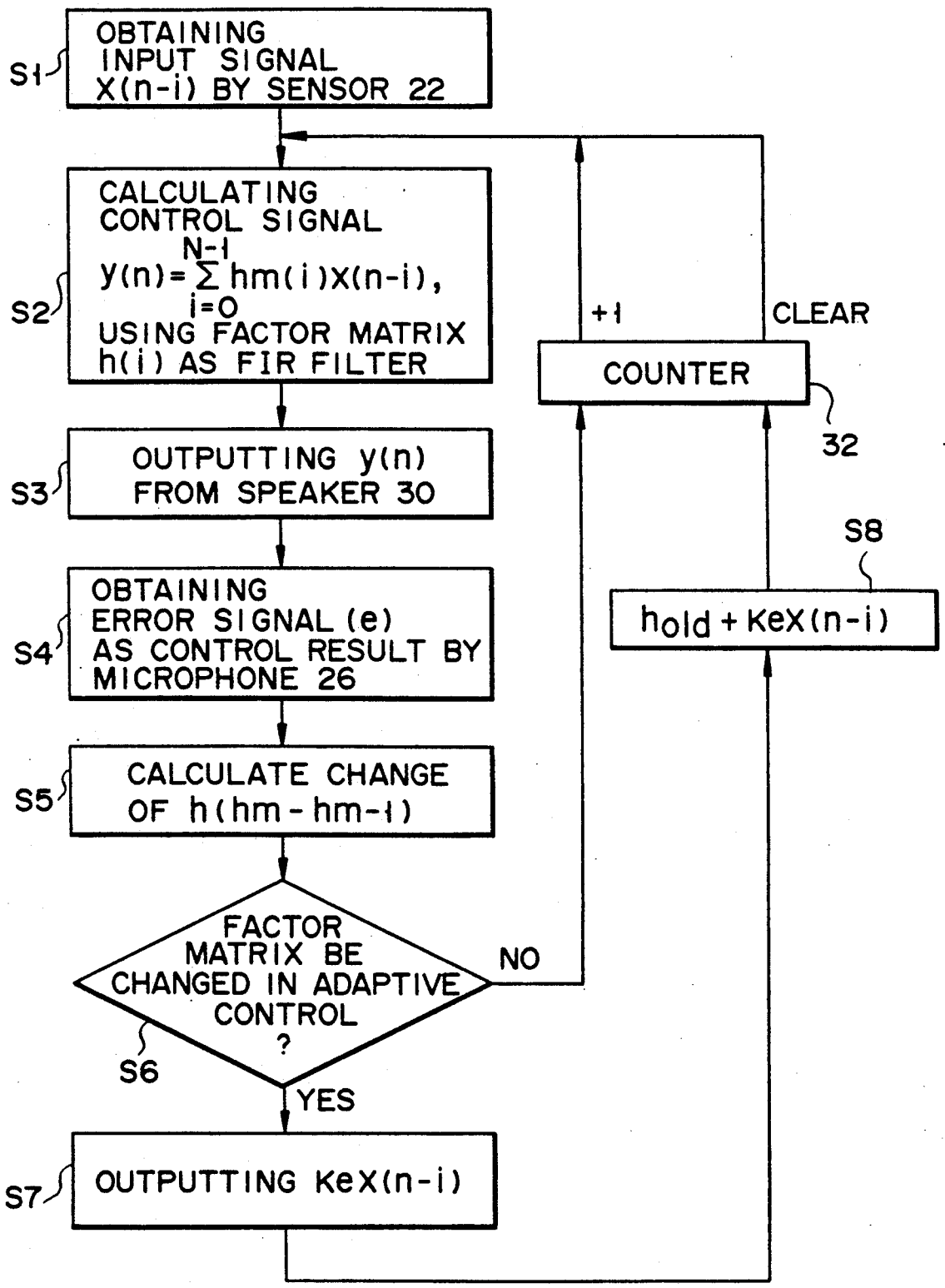

Thereafter, the noise at the aperture 13 of the chamber 12 is continuously canceled by using the noise cancellor, according to the processes shown in FIG. 2.

The first sensor 22 detects noise from the compressor 10 and obtains input signals X(n−1) (Process S1). The signal processor 25 calculates control signals S2(n) by covoluting the input signals by the filter factor series hm(i) as FIR filters according to Eq. (5) (Process S2). These control signals are inputted to the speaker 29 via the D/A converter 29, and the speaker 30 produces control sound (Process S3). At the aperture 13, the noise from the compressor 10 and the control sound from the speaker 30 interfere with each other so as to cancel each other. Thus, if the noise and the sound completely cancel each other, the sound pressure at the aperture 13 is perfectly zero. In genera, however, it is very rare that the sound pressure is completely zero in this step.

Therefore, the sound pressure at the aperture 13 is detected by the second sensor 26 and inputted to the signal processor 25 as an error signal e (Process S4). The signal processor 25 changes the filter factor series h(i), based on the error signal, such that the sound pressure at the aperture 13 becomes zero. This change is made according to Eq. (6). Specifically, the signal processor 25 calculates the value of change ($h_m$−$h_{m-1}$) of the filter factor series h (Process S5) and judges, according to the following expression whether the filter factors should be changed (Process S6):

$$(|h_m - h_{m-1}|)N > \epsilon \qquad (7)$$

where N is the counting number counted by a change-frequency counter 32, and $\epsilon$ is a predetermined constant.

When the absolute value of the change (hm−hm−1) multiplied by N is smaller than the constant $\epsilon$, it is judged that no change is necessary, and the process is returned from Process 6 to Process 2. Accordingly, the noise cancelation is carried out by using the same filter factor series hm(i) as that of last time.

When it is judged that the filter factor series should be changed, the signal processor 25 outputs Ke X (n−i) defined by Eq. 6 (Process S7) and calculates new filter factor series $h_{m+1}$, based on Eq. 6 (Process S8). Then, the filter factor series in Process S2 are changed from $h_m$ to $h_{m+1}$, and new control signals S2(n) are calculated from the new filter factor series.

The counter 32 is constituted such that it counts the number of clock pulses of a constant period and the old counting number of the clock pulses are cleared when the filter factor series are changed.

Thereafter, the above processes are repeated.

With this noise cancellor, the decision as to whether or not the filter factor series should be altered is made according to the predetermined condition, or according to Expression (7), and the frequency of the alteration is determined by Expression (7) as well. When the value of the alteration is large, the alteration is made frequently. On the contrary, when the value thereof is small, the frequency of the alteration is small. As a result, the optimum convergence ratio of the control system can be set in accordance with the variation of the operational condition of the compressor 10, the change of the acoustic transfer functions in the chamber 12, and the like. Accordingly, this noise cancellor realizes adaptive active noise control which satisfies both high stability and high control convergence. If the frequency of the switching is set to be large as the change of the operational condition and the acoustic transfer functions is large, and if it is set to be small as the change of them is small, the control can be performed without according to Expression (7).

Once the filter factors are determined, the change of the absolute value $|h_m - h_{m-1}$ in Expression (7) is small enough. Thus, even if an external noise propagates into the chamber 12, it can be prevented that the filter factor series is changed by the malfunction of the noise cancellor, thereby facilitating more stable noise control.

Figure 3:
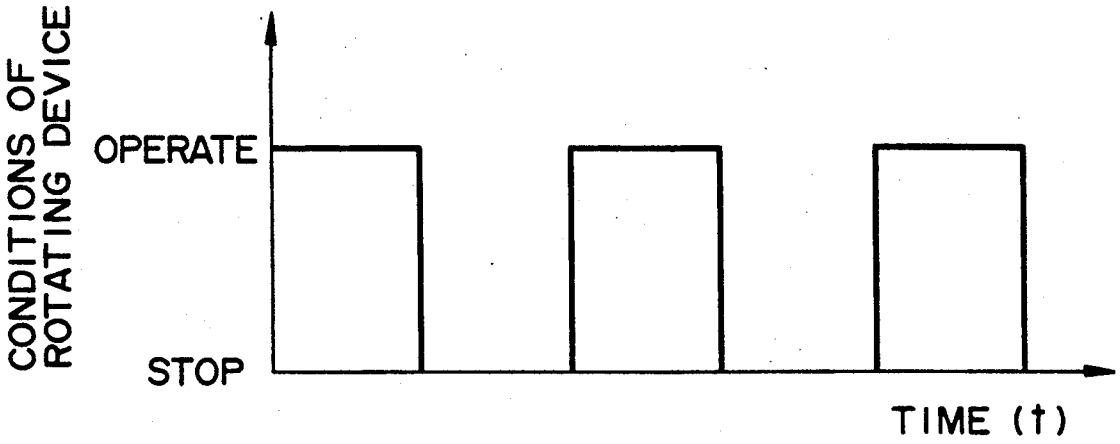
Figure 4:
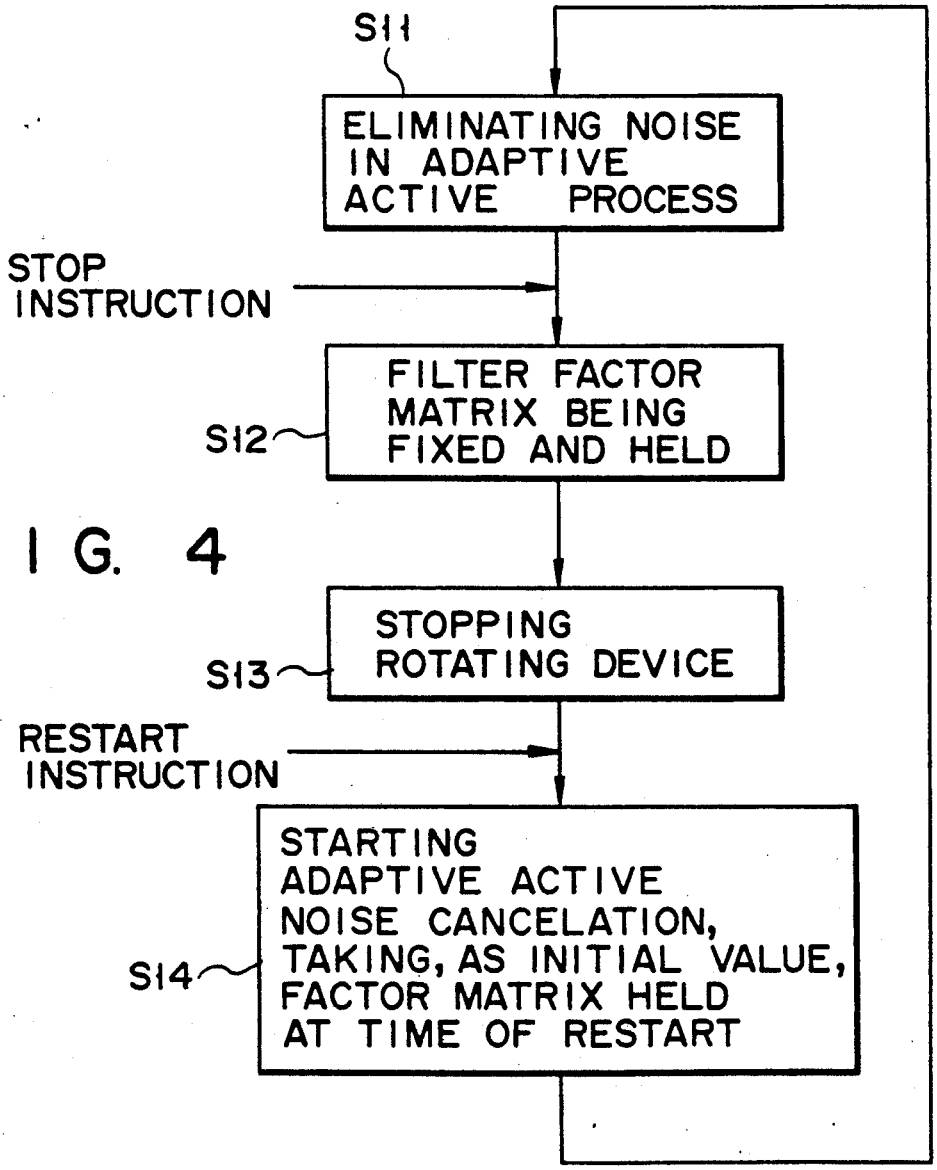

The noise cancellor is constructed in consideration of the fact that the compressor 10 operates intermittently as shown in FIG. 3. When the stop instruction to the compressor 10 is outputted while the above mentioned noise control is being carried out, as is shown by Process S11 in FIG. 4, the control device 31 memorizes, as fixed value, the filter factors hm and hm-1 which are being used at this moment (Process S12). The signal processor 25 sends a storage-finishing signal to the control device 31 at the time when the storage of the filter factors is completed, and then the control device 31 stops the operation of the compressor 10 (Process S13).

Thereafter, when the starting signal to the compressor 10 is applied from the control device 31 to the signal processor 25, the processor 25 assumes the previously stored filter factors $h_m$ and $h_{m-1}$ as the initial value and starts the noise control shown in FIG. 2 (Process S14).

According to the above described construction, while the compressor 10 is not operated, no alteration of the filter factor series is made and no noise is superposed on the filter factor series. When the compressor 10 is operated again, the noise control starts by taking the previously stored filter factor series as the initial value. Therefore, the convergence of the noise control can be quickened as compared with the case in which the filter factor series which is zero-cleared or mixed with noise is used as an initial value. This means that, with this noise cancellor, a quick change to the optimum adaptive active noise control is possible after the compressor has started.

The concept, wherein the filter factors are fixed when the instruction to stop a driving device as a noise source is inputted and the previously stored filter factor series is used as the initial value when the instruction to start the driving device is inputted, can be adopted to other systems than the ordinary active noise cancellor and the adaptive active noise cancellor.

Figure 5:
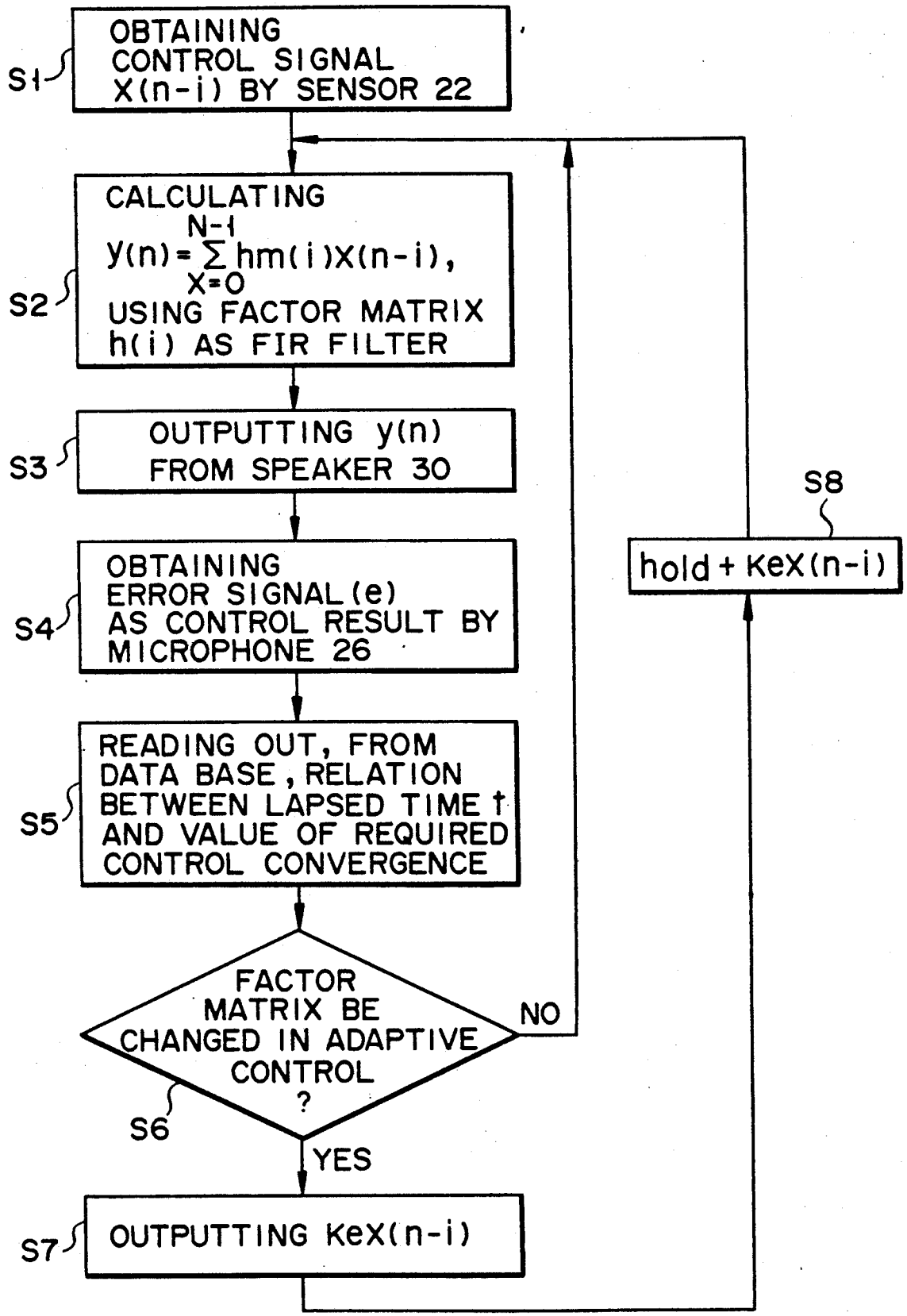
FIG. 5 is a flow chart illustrating the process of the control of a noise cancellor of a second embodiment, in accordance with an elapsed time after a driving device in started.

With the above embodiment, the value of the change of the filter factors $(h_m - h_{m-1})$ is calculated and the timing of change of the filter factor is determined by this calculated value and the number of counting N by the change-frequency counter 32. In some systems for noise control, the factors affecting the transfer functions, such as the sound speed in the chamber, the output of the speaker and the like, change in specific characteristic. In this case, the frequency of setting the adopting control may be changed in accordance with an elapsed time t after the driving device and the noise cancellor are started. FIG. 5 shows a flow chart related to a noise cancellor using this control system.

With the embodiment shown in FIG. 5, in the Process S5, the signal processor reads out the elapsed time t and the value of a control convergence required at the time t, from a data base which has previously memorized the characteristics of the factors affecting the transfer functions. Thereafter, in Process S6, the signal processor judges whether the filter factor series should be changed at the elapsed time. The other control processes are the same as those of FIG. 2.

The adapting characteristic of this control system is a little worse than that of the first embodiment. However, the noise cancellor itself and the processing routine are greatly simplified.

The first embodiment provides adaptive active control for changing the filter factors in response to the error signals detected by the second sensor arranged at the object point. Alternatively, when noise control is performed with respect to a driving device such as a compressor which generates noise with almost constant frequencies, the noise cancellor may be constructed as shown in FIG. 6.

Figure 6:
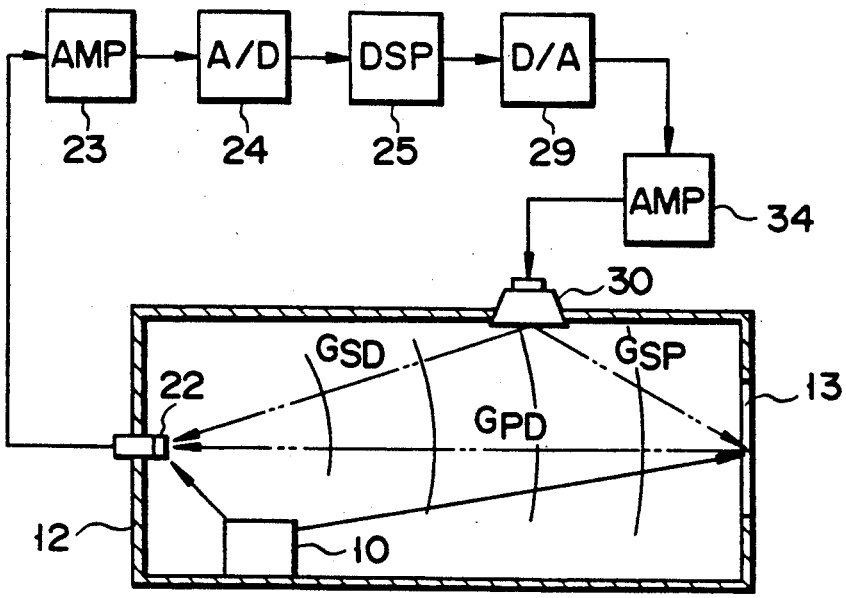
Figure 7A:
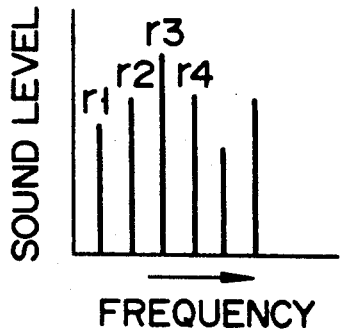
FIG. 7A is a view showing a frequency distribution of a compressor noise.
Figure 8A:
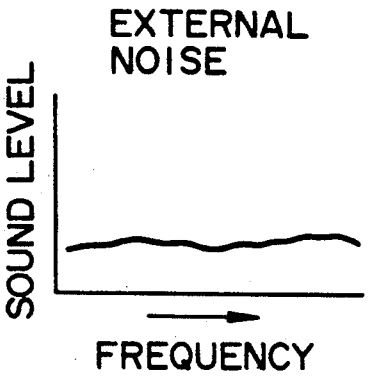
FIG. 8A is a view showing a frequency distribution of external noise.
Figure 8B:
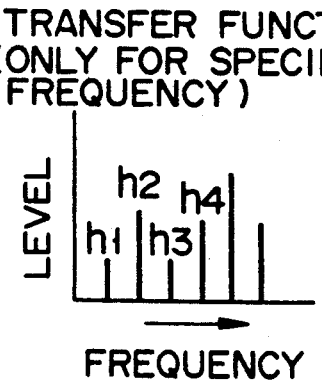
FIG. 8B is a view showing the distribution of the components of the acoustic transfer functions corresponding to the frequency distribution of FIG. 8A.

As seen from the wave frequency distribution chart shown in FIG. 7A, the noise generated from a compressor 10 mostly consist of frequency components which include the rotating frequency of the compressor 10 and the integral multiples r1, r2, r3, r4 and so on of the rotating frequency. On the contrary, an external noise generally contains a wide range of frequency components as shown in FIG. 8A. The third embodiment shown in FIG. 6 is constructed, taking this phenomenon in consideration. With this third embodiment, the control signals are obtained by multiplying the input signals, which is detected by a first sensor, by the filter factor series, like the control signals with the first embodiment. However, in this embodiment, specific frequencies based on the rotating frequency of the compressor 10 are only used as the filter factors, thereby preventing the affection of an external noise having frequencies other than the specific frequencies.

Figure 7B:
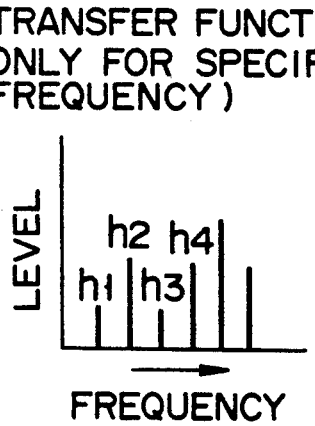
FIG. 7B is a view showing the distribution of the components of the acoustic transfer functions corresponding to the frequency distribution of FIG. 7A.
Figure 7C:
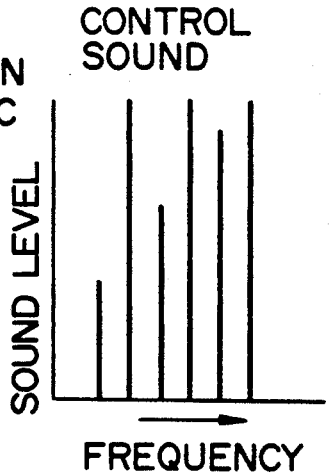
FIG. 7C is a view showing a frequency distribution of control sounds.
Figure 8C:
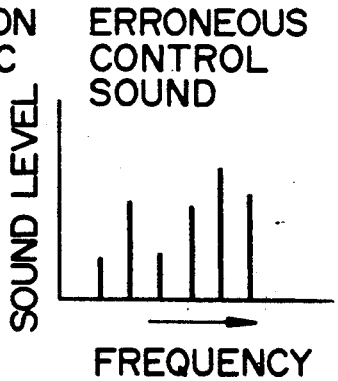
FIG. 8C is a view showing a frequency distribution of erroneous control sounds.

The operation of the third embodiment will be explained by using a transfer function of the frequency domain designation. The filter factor series is determined only by using the components of the acoustic transfer functions h1, h2, h3, h4 and so on (FIG. 7B) corresponding to the frequencies r1, r2, r3, r4 and so on which are the most part of the frequencies of the noise generated from the compressor 10. Thus, the control sound corresponding to the noise from the compressor are produced by the speaker as shown in FIG. 7C, and so called erroneous control sound is as shown in FIG. 8C. As understood from these figures, the noise cancellor of the third embodiment does not respond to the most part of the frequencies of the external noise. Since the frequency components of the external noise, to which the cancellor response, are dispersed, they have very few influence on the noise control effects. Accordingly, the third embodiment provides a noise cancellor which does not malfunction due to an external noise and can carry out a stable noise control.

As shown in FIG. 6, the noise cancellor according to the third embodiment is provided with a first sensor 22 arranged in a chamber at the vicinity of the compressor 10 as a noise source. The noise detected by the sensor 22 is converted to input signals which are inputted to a signal processor 25 through an amplifier 23 and an A/D converter 24. The input signals are processed and converted to control signals by the processor 25 and thereafter are input to a speaker 30 via a D/A converter and an audio amplifier 34. The noise at the aperture 13 as an object point is canceled by the sound produced by the speaker 30.

In the third embodiment, the arithmetic process in the signal processor 25 is performed based on an FIR filter process wherein the filter factor series h(i), as an FIR filter, are previously set in the register of the signal processor in the form of a time domain, that is, in the form of an impulse response function. Every time the input signal as a discrete data is sent from the converter 24, the values of the filter factor series are multiplied by the input signal from the first value to the last one in turn. Every time this arithmetic operation is completed, the input signal is shifted, and the filter factors are multiplied by the shifted input signal. The new values are added to the values resulting from the previous arithmetic operation. The convolution in the time domain (that is, the control signals S2(n)) is calculated from the arithmetic operation based on Eq. (5).

Figure 9:
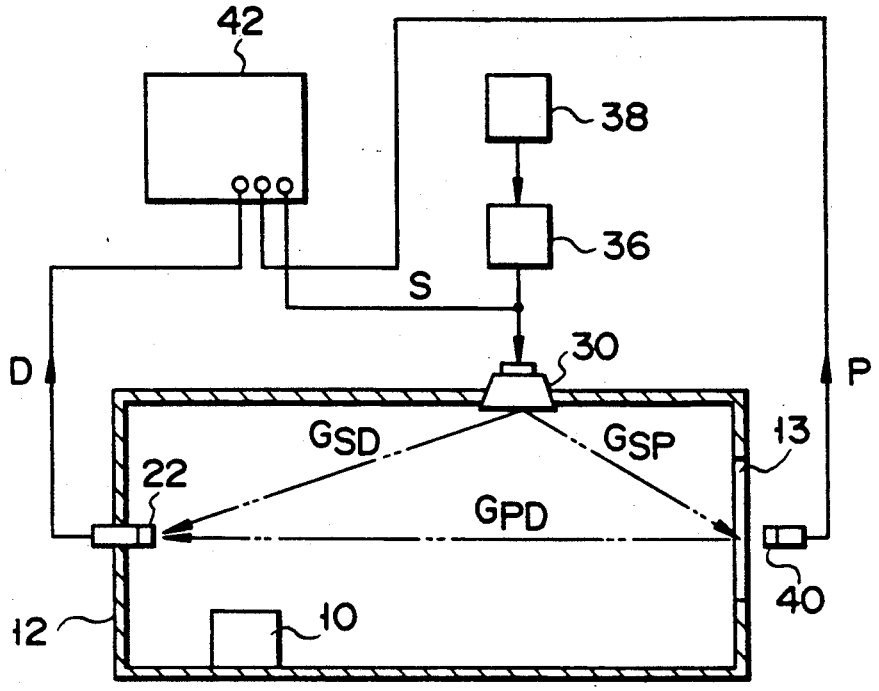

As shown in FIG. 7A, in view of the frequency domain, the filter factor series set in the signal processor 25 correspond only to the rotating frequency of the compressor 10 and its integral multiples, that is, the specific frequency components related to the rotating frequency of the compressor. The filter factor series is obtained as follows:

First, as shown in FIG. 9, the speaker 30 of the noise cancellor is connected to a white noise generator or a sweep oscillator 38 via an amplifier 36. A signal S sent to the speaker 30 is taken as a reference signal, and a signal D detected by the first sensor 22 and a signal P detected by a second sensor such as a microphone 40 arranged at the object point 13 are taken to be response signals. The signals S, D and P are inputted to a transfer function measuring device 42 such as a multi-channel FFT analyzer whereby a transfer function $G_{SD}$ between the speaker 30 and the first sensor 22 and a transfer function $G_{SP}$ between the speaker and the microphone 40 are obtained. A transfer function $G_{PD}$ from the object point 13 to the first sensor 22 is obtained from the transfer functions $G_{SD}$ and $G_{SP}$.

Modifying Eq. 3, it is found that $$h=1/\{T21-(T11/T12)\cdot T22\} \quad (8)$$

Rewriting Eq. 8 by using the symbols of the above transfer functions, $$h=1/(G_{SD}\cdot G_{SP}\cdot G_{PD}) \quad (9)$$

From these values of $G_{SD}$, $G_{SP}$ and $G_{PD}$, the transfer function corresponding to the filter factors is obtained in the form of a frequency domain designation. When the obtained transfer function assumes in the form shown in FIG. 7A, only the frequency components corresponding to the rotating frequency of the compressor 10 and the integral multiples thereof are picked up and the other frequency components are neglected so that the dispersed transfer function components h1, h2, h3 and so on are obtained as shown in FIG. 7B. The obtained transfer function components are converted by means of inverse Fourier transform to the form of an impulse response function, whereby a filter factor series to be set in the signal processor 25 are obtained.

The noise cancellor of the third embodiment is designed such that the characteristics of the impulse response function correspond to the respective frequencies of the compressor noise, for example, 50 Hz, 100 Hz, 150 Hz and so on.

Figure 10:
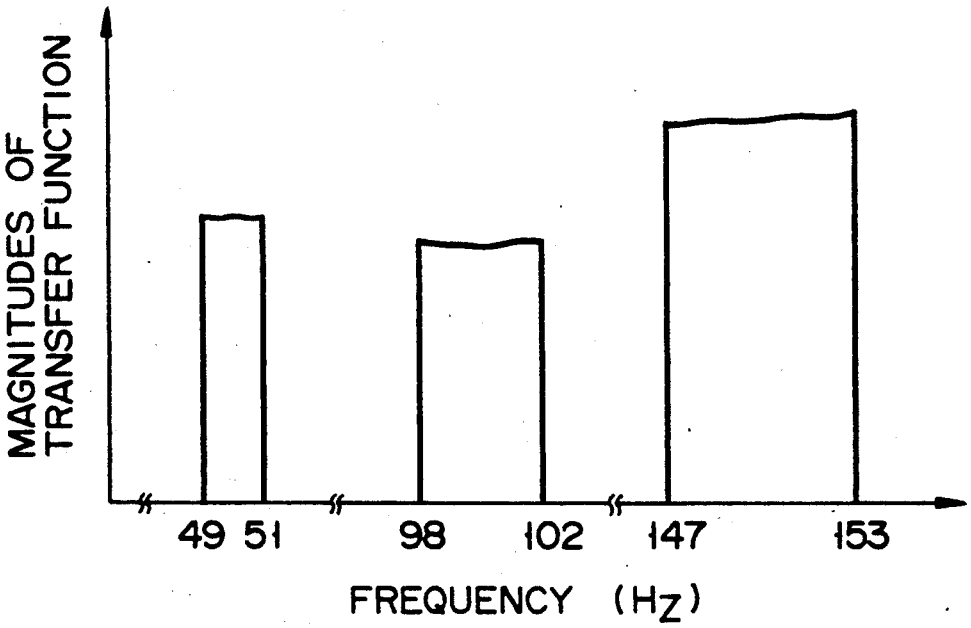
FIG. 10 is a view showing a frequency distribution of a driving device noise.

However, the compressor does not rotate at a constant rotational speed, and its speed varies a little depending on the loads In order to follow this variation, the impulse response function may have a characteristic to response to small variation ranges of frequencies including the above mentioned specific frequencies such as 49 to 51 Hz, 98 to 102Hz, 147 to 153 Hz and so on, as shown in FIG. 10. By doing so, noise elimination can carried out well even if the frequencies of the noise vary as in accordance with change in the rotational speeds of the compressor.

With the third embodiment, the dispersed transfer function components corresponding to the frequencies of the compressor are obtained and are converted by means of inverse Fourier transform to the form of an impulse response function, then forming control signals, that is, time series datum to be sent to the speaker, by means of the FIR filter system.

Figure 11:
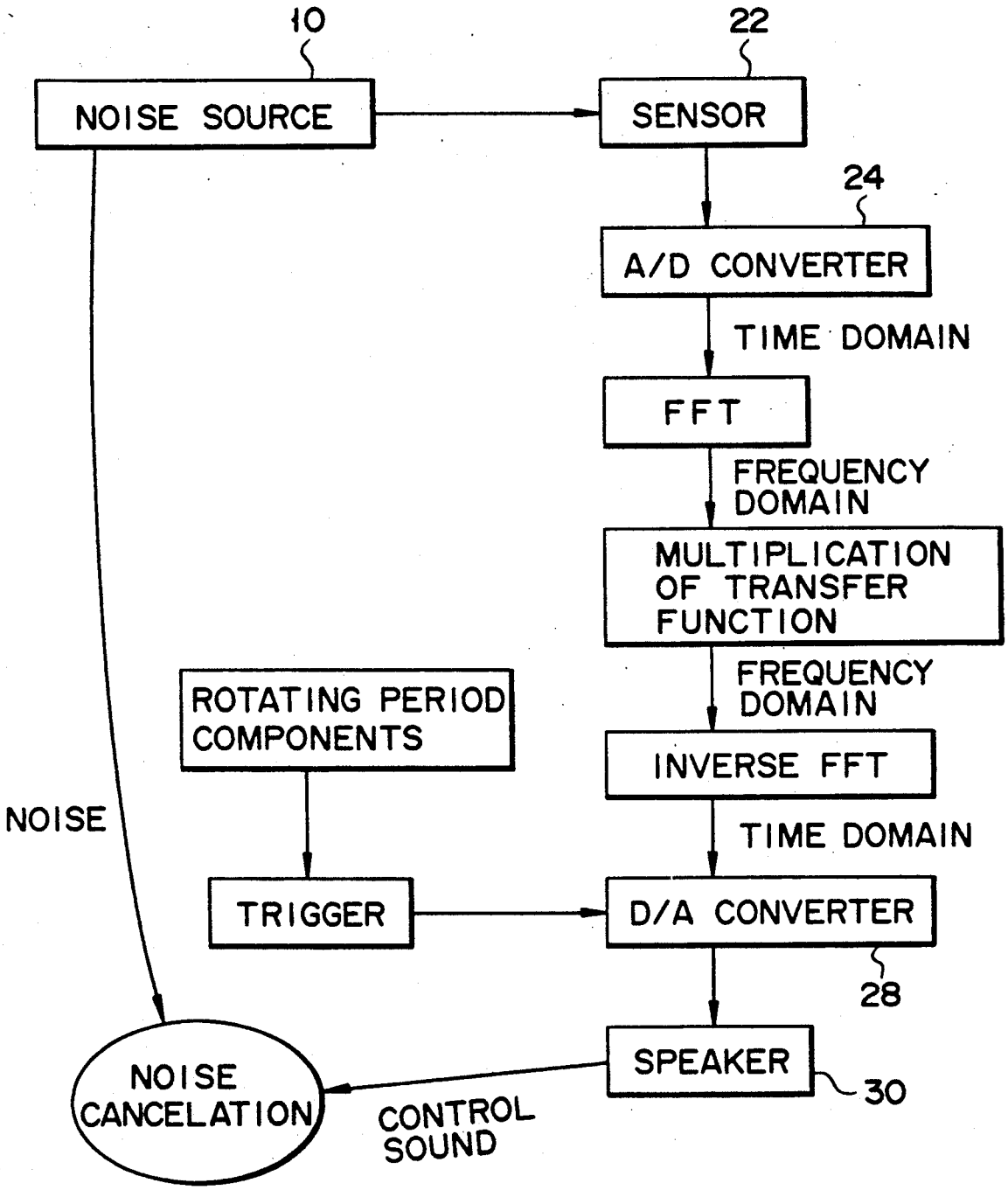
FIG. 11 is a flow chart for illustrating another signal processing system.

However, the control signals may be directly obtained from the transfer function of the frequency domain designation. In this case, as shown in FIG. 11, the input signals detected by the first sensor are converted by means of Fourier transform into the datum of the frequency domain, and then the transfer function components set in the signal processor are convoluted by the datum. The obtained data series is converted again to the time series signals by means of inverse Fourier transform and is input to the speaker. Since the arithmetic operation is carried out after the number of datum amounts to the number of sample points, time delay takes place. Therefore, it is necessary to control the timing at which the speaker produces sounds, by using trigger signals synchronizing with the rotation of the compressor. Like the case of the third embodiment, noise elimination is effectively carried out at the object point with this system without being disturbed by an external noise.

With this system, the transfer function components may also be set within the frequency ranges of 49 to 51 Hz, 98 to 102 Hz, 147 to 153 Hz and so on so that effective noise elimination is attained even if the frequency of noise slightly varies as in accordance with the change in the rotational speed of the compressor.

In the above description, a compressor is used as the noise source but is not limited thereto. This invention may be applied to the elimination of a noise generated from other drive devices. Moreover, this invention is applicable not only to the cancelation of the noise from a compressor provided in a chamber but also to the cancelation of the noise from the compressor in a refrigerator or the like.

What is claimed is:

1. A noise cancellor for canceling noise which is generated from a driving device and propagates to a predetermined object point, comprising:

a first sensor for detecting the noise generated from the driving device and converting the noise to electric signals;

signal processing means for multiplying said electric signals by a predetermined factor series to form control signals;

sound producing means for producing, in response to said control signals, sound which interferes with the noise so as to cancel the noise at the object point; and a second sensor for detecting sound at the object point, converting them to electric signals, and inputting them to the signal processing means;

said signal processing means including adaptive active control means for changing said factor series in response to the electric signals detected by said second sensor, and selecting means for selecting a first control mode wherein said adaptive active control means is used or a second control wherein said factor series is fixed, in accordance with a predetermined condition, until the electric signals from the second sensor have a value which falls within a predetermined range.

2. A noise cancellor according to claim 1, wherein said selecting means includes means for determining the frequency of change from said second control mode to said first control mode, in accordance with a difference between the present factor series and a factor series of last time.

3. A noise cancellor according to claim 1, wherein said selecting means has means for determining the frequency of change from said second control mode to said first control mode, in accordance with a lapsed time after the driving device is started.

4. A noise cancellor according to claim 1, wherein said selecting means has means for determining the frequency of change from said second control mode to said first control mode, in accordance with an operating condition of the driving device or transfer functions around the driving device.

5. A noise cancellor according to claim 1, which further comprises a control unit for sending instructions of stop and restart of the driving device to the signal processing means, and wherein said signal processing means includes output means for memorizing the present factor series when said signal processing means receives the instruction of stop and for outputting the memorized factor series as an initial value when said signal processing means receives the instruction of restart.

6. A noise cancellor for canceling noise which is generated from a driving device and propagates to a predetermined object point comprising:

a first sensor for detecting said noise generated from the driving device and converting the noise to electric signals;

signal processing means for multiplying said electric signals by a predetermined factor series to form control signals;

sounding means for producing, in response to said control signals, sound which interferes with said noise so as to cancel the noise at said object point; and a second sensor for detecting sound at said object point, converting said sound to electric signals, and inputting them to said signal processing means;

said signal processing means including adaptive active control means for changing said factor series in response to said electric signals detected by said second sensor, and adjusting means for adjusting frequency of change of said factor series in accordance with a predetermined condition, until the electric signals from the second sensor have a value which falls within a predetermined range.

7. A noise cancellor according to claim 6, wherein said adjusting means has means for determining whether said factor series should be changed, based on the following equation:

$$(|h_m - h_{m-1}|)N > \epsilon,$$

where $h_m$ is a factor series set last time, $h_{m-1}$ is a factor series set just before last time, N is a number for determination, and $\epsilon$ is a constant.

8. A noise cancellor for canceling noise which is generated from a driving device and propagates to a predetermined object point, comprising:

a first sensor for detecting said noise generated from the driving device and converting said noise to electric signals;

signal processing means for multiplying said electric signals by a predetermined factor series to form control signals;

sound producing means for producing, in response to said control signals, sound which interferes with said noise so as to cancel said noise at said object point;

a second sensor for detecting sound at said object point, converting the sound to electric signals, and inputting them to said signal processing means; and a control unit for sending instructions of stop and restart of said driving device;

said signal processing means including adaptive active control means for changing the present factor series in response to said electric signals detected by said second sensor, and output means for memorizing the present factor series when said output means receives said instruction of stop and for outputting, as an initial value, said factor series stored in said output means when said output means receives said instruction of restart.

9. A noise cancellor for canceling noise which is generated from a driving device having a predetermined driving frequency and propagates to a predetermined object point, comprising:

a sensor for detecting noise generated from said driving device and converting it to time series signals;

signal processing means for storing impulse response functions responding to only specific frequencies based on the driving frequency of said driving device and for producing control signals by convoluting said time series signals by said impulse response functions; and sound producing means for producing, in response to said control signals, sound which interferes with said noise so as to cancel said noise at said object point.

10. A noise cancellor according to claim 9, wherein said impulse response functions are obtained by means of inverse Fourier transform of components of transfer functions which correspond to said driving frequency and integral multiples thereof.

11. A noise cancellor according to claim 9, wherein said impulse response functions are obtained by means of inverse Fourier transform of transfer functions, which have frequencies falling within ranges over which said driving frequency and integral multiples thereof are allowed to change.

12. A noise cancellor for canceling noise which is generated from a driving device having a predetermined driving frequency and propagates to a predetermined object point, comprising:

a sensor for detecting noise generated from the driving device and converting it to time series signals;

signal processing means for holding only components of transfer functions, which have specific frequencies based on said driving frequency of said driving device, converting the time series signals to frequency domain signals by means of Fourier transform, multiplying said frequency domain signals by said components of the transfer functions, and converting the resultant to time series control signals by means of inverse Fourier transform; and sound producing means for producing, in response to said time series control signals, sound which interferes with said noise so as to cancel said noise at the object point.

13. A noise cancellor according to claim 12, wherein said components of said transfer functions include components corresponding to said driving frequency, integral multiples thereof and predetermined frequency ranges over which said driving frequency and integral multiples thereof are allowed to change.

14. A method of canceling noise which is generated from a driving device and propagates to an object point, comprising:

a first converting step of detecting noise and converting it to electric signals;

a producing step of producing control signals by multiplying said electric signals by a predetermined factor series;

a canceling step of producing, in response to the control signals, sound which interferes with said noise so as to cancel said noise at the object point; and a second converting step of detecting sound at said object point to convert said sound to electric signals;

said producing step including a selecting process of selecting adaptive active control wherein said factor series is changed in response to said electric signals converted by said second converting step or active control wherein said factor series is to be fixed, in accordance with a predetermined condition, until the electric signals from the second sensor have a value which falls within a predetermined range.

15. A method according to claim 14, wherein said selecting step includes a process of determining the frequency of change from said active control to said adaptive active control, in response to a difference between the present factor series and a factor series of last time.

16. A method according to claim 15, wherein said selecting step includes a process of determining the frequency of change from said active control to said adaptive active control in response to a lapsed time after the driving device is started.

17. A method according to claim 14, wherein said selecting step includes a process of determining the frequency of change from said fixed active control to said adaptive active control, in accordance with an operating condition of the driving device or acoustic transfer functions around the driving device.

18. A method according to claim 14, wherein said producing step includes a first process of memorizing the present factor series when a stop instruction of said driving device is output and a second process of outputting, as an initial value, the memorized factor series when a restart instruction of said driving device is outputted.

19. A method of canceling noise which is generated from a driving device and propagates to an object point, comprising:

a first converting step of detecting noise and converting it to electric signals;

a producing step of producing control signals by multiplying said electric signals by a predetermined factor series;

a canceling step of producing, in response to the control signals, sound which interferes with said noise so as to cancel said noise at said object point;

a second converting step of detecting sounds at said object point to convert said sound to electric signals; and a changing step of changing said factor series in response to said electric signals converted by said second converting step, said changing step including a process of adjusting the frequency of change of said factor series, in accordance with a predetermined condition, until the electric signals from the second sensor have a value which falls within a predetermined range.

20. The method according to claim 19, wherein said frequency of change of said factor series is determined by the following expression:

$$(|h_m - h_{m-1}|)N > \epsilon,$$

where $h_m$ is a factor series of last time, $h_{m-1}$ is a factor series from which said factor series of last time was changed, N is a number for determination, and $\epsilon$ is a constant.

21. A method of canceling noise which is generated from a driving device and propagates to an object point, comprising:

a converting step of detecting noise generated from said driving device and converting it to electric signals;

a producing step of producing control signals by multiplying said electrical signals by a predetermined factor series;

a canceling step of producing, in response to the control signals, sound which interferes with said noise to cancel said noise at the object point;

a memorizing step of memorizing the present factor series when a stop instruction of said driving device is outputted; and an outputting step of outputting the stored factor series as an initial value when a restart instruction of said driving device is outputted.

22. A method of canceling noise which is generated from a driving device having a predetermined driving frequency and propagates to an object point, comprising:

a step of detecting noise generated from said driving device and converting it to time series signals;

a step of producing control signals by convoluting said time series signals by impulse response functions which response to only specific frequencies based on said driving frequency of said driving device; and a step of producing, in response to the control signals, sound which interferes with said noise to cancel said noise at said object point.

23. A method according to claim 22, wherein said impulse response functions are obtained by means of inverse Fourier transform of components of transfer functions which correspond to said driving frequency and integral multiples thereof.

24. A method according to claim 22, wherein said impulse response functions are obtained by means of inverse Fourier transform of transfer functions, which have frequencies falling within ranges over which said driving frequency and said integral multiples thereof are allowed to change.

25. A method of canceling noise which is generated from a driving device having a predetermined driving frequency and propagates to a predetermined object point, comprising:

a converting step of detecting noise generated from the driving device and converting it to time series signals;

a processing step of holding only components of transfer functions, which have specific frequencies based on said driving frequency of said driving device, converting the time series signals to frequency domain signals by means of Fourier transform, multiplying said frequency domain signals by said components of the transfer functions, and converting the resultant to time series control signals by means of inverse Fourier transform; and a canceling step of producing, in response to said time series control signals, sound which interferes with said noise so as to cancel said noise at the object point.

26. A method according to claim 25, wherein said components of said transfer functions include components corresponding to said driving frequency, integral multiples thereof and predetermined frequency ranges over which said driving frequency and integral multiples thereof are allowed to change.

* * * * *